US008171599B1

(12) United States Patent
Cheng et al.

(10) Patent No.: US 8,171,599 B1
(45) Date of Patent: May 8, 2012

(54) HINGE

(75) Inventors: Yung-Chi Cheng, Bade (TW); Ching-Feng Hsieh, Taipei (TW)

(73) Assignee: Askey Computer Corp. (TW)

( * ) Notice: Subject to any disclaimer, the term of this patent is extended or adjusted under 35 U.S.C. 154(b) by 49 days.

(21) Appl. No.: 12/956,102

(22) Filed: Nov. 30, 2010

(30) Foreign Application Priority Data

Oct. 15, 2010 (TW) ..... 99219952 A

(51) Int. Cl.
*E05F 1/08* (2006.01)

(52) U.S. Cl. ..... 16/268; 16/262; 16/265; 16/352; 16/374; 16/381

(58) Field of Classification Search ..... 16/260, 16/261, 262, 265, 268, 263, 352, 86.1, 86.2, 16/371, 374, 375, 380, 381
See application file for complete search history.

(56) References Cited

U.S. PATENT DOCUMENTS

| | | | | | |
|---|---|---|---|---|---|
| 170,314 | A * | 11/1875 | Toedt | | 16/318 |
| 516,546 | A * | 3/1894 | McCauley | | 16/338 |
| 1,455,550 | A * | 5/1923 | Rodell | | 16/375 |
| 4,827,568 | A * | 5/1989 | Ramsauer | | 16/266 |
| 5,058,236 | A * | 10/1991 | Henson | | 16/222 |
| 5,956,809 | A * | 9/1999 | Hodgson | | 16/224 |
| 5,966,778 | A * | 10/1999 | Ray | | 16/374 |
| D447,679 | S * | 9/2001 | Parisi | | D8/323 |
| 6,374,458 | B1 * | 4/2002 | Finkelstein | | 16/235 |
| 7,603,746 | B1 * | 10/2009 | von Resch et al. | | 16/245 |

FOREIGN PATENT DOCUMENTS

| | | |
|---|---|---|
| TW | M255893 | 1/2005 |
| TW | M331028 | 11/2007 |

* cited by examiner

*Primary Examiner* — Chuck Y. Mah
(74) *Attorney, Agent, or Firm* — Schmeiser, Olsen & Watts, LLP

(57) ABSTRACT

A hinge, configured to be stably positioned by a simple mechanism and advantageously characterized by ease of installation and uninstallation, includes a first connection member and a second connection member. The first connection member includes a first fixing unit and a support unit. The first fixing unit has a first fixing side and a connecting side. The support unit is connected to the connecting side, and has a cylindrical receiving chamber and a via in communication with the cylindrical receiving chamber. The via is penetrable by a rod-shaped tool. The second connection member includes a second fixing unit and a post connected to the second fixing unit. The second fixing unit has a second fixing side. The post is removably disposed in the cylindrical receiving chamber and has a positioning hole for receiving an end portion of the rod-shaped tool when aligned with the via.

5 Claims, 8 Drawing Sheets

HINGE

CROSS-REFERENCE TO RELATED APPLICATION

This non-provisional application claims priority under 35 U.S.C. §119(a) on Patent Application No(s).099219952 filed in Taiwan, R.O.C. on Oct. 15, 2010, the entire contents of which are hereby incorporated by reference.

FIELD OF THE TECHNOLOGY

The present invention relates to a hinge, and more particularly, to a hinge configured to be stably positioned by a simple mechanism and advantageously characterized by ease of installation and uninstallation.

BACKGROUND

Hinges are widely used in door frames and door panels. In general, a conventional hinge is used in connecting a door frame and a door panel and opening/shutting a door which is essentially comprised of the door frame and the door panel. To meet human beings' needs further, it is feasible for a conventional hinge to serve a positioning purpose as well, by working in conjunction with a hydraulic positioning mechanism disposed between the door frame and the door panel. However, the hydraulic positioning mechanism that serves the aforesaid positioning purpose is structurally intricate and difficult to install between the door frame and the door panel and uninstall. In case a heavy electronic device, such as a circuit system installed on the lid of an electronic mailbox, is installed on the door panel, the door panel will be unlikely to be well-positioned under the weight of the electronic device, and in consequence the door may shut by itself at any time, thereby posing a threat to user safety.

In attempt to overcome the aforesaid drawbacks of the prior art, Taiwan Patent Nos. M255893 and M331028 were put forth. M255893 proposes effectuating a positioning function by the coordinated operation of a spring and a serrate inner side of a hinge. However, a pin disclosed in M255893 for serving a rotational purpose is riveted to the hinge and thus cannot be removed therefrom. Likewise, a heavy electronic device installed on a door panel of M255893 poses a threat to user safety as described above. The unremovable pin of M255893 renders it difficult to perform maintenance on the electronic device installed on the door panel. M331028 proposes effectuating a positioning function by the coordinated operation of a spring, a positioning ball, and a positioning hole. However, in M331028, removal of the spring and the positioning ball from the positioning hole entails separating a screw and a nut and thus is difficult. In case a heavy electronic device is installed on the door panel of M331028, users will be endangered in the aforesaid manner. For the aforesaid reason, maintenance of the electronic devices applicable to M331028 is seldom easy.

Accordingly, it is imperative to provide a hinge configured to be stably positioned by a simple mechanism and advantageously characterized by ease of installation and uninstallation.

SUMMARY

In light of the aforesaid drawbacks of the prior art, it is an objective of the present invention to provide a hinge configured to be stably positioned by a simple mechanism and advantageously characterized by ease of installation and uninstallation.

In order to achieve the above and other objectives, the present invention provides a hinge for movably coupling a door panel and a door frame together and positioned by a rod-shaped tool. The hinge comprises a first connection member and a second connection member. The first connection member comprises a first fixing unit and a support unit. The first fixing unit has a first fixing side and a connecting side substantially perpendicular to the first fixing side. The first fixing side is fixed to the outer surface of the door frame. The support unit is coupled to the connecting side, has therein a cylindrical receiving chamber, and has therein a via being in communication with outside and the cylindrical receiving chamber and penetrable by the rod-shaped tool. The second connection member comprises a second fixing unit and a post. The second fixing unit has a second fixing side fixed to a flat surface of the door panel. The post is connected to the second fixing unit and removably disposed in the cylindrical receiving chamber so as for the post to be movably coupled to the door panel and the door frame and rotated inside the cylindrical receiving chamber to thereby enable the door panel to engage with and disengage from the door frame. The post has therein a positioning hole for receiving an end portion of the rod-shaped tool when aligned with the via.

Accordingly, the present invention provides a hinge configured to be stably positioned by a simple mechanism and advantageously characterized by ease of installation and uninstallation.

BRIEF DESCRIPTION OF THE DRAWINGS

A detailed description of further features and advantages of the present invention is given below so that a person skilled in the art can understand and implement the technical contents of the present invention and readily comprehend the objectives, features, and advantages thereof by reviewing the disclosure of the present specification and the appended claims in conjunction with the accompanying drawings, in which:

DETAILED DESCRIPTION

Figure 1:
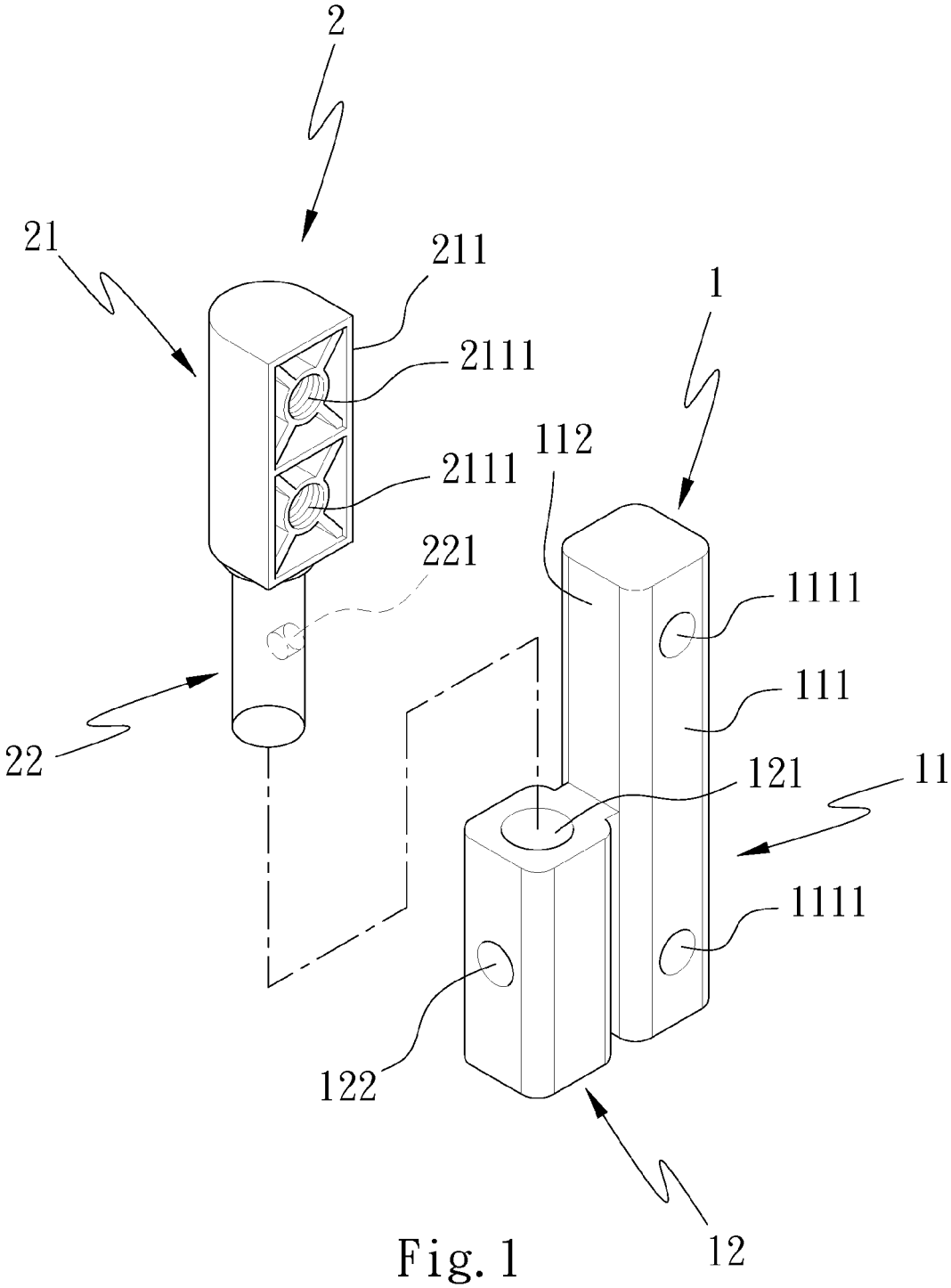
FIG. 1 is an exploded view of a hinge according to an embodiment of the present invention.
Figure 2:
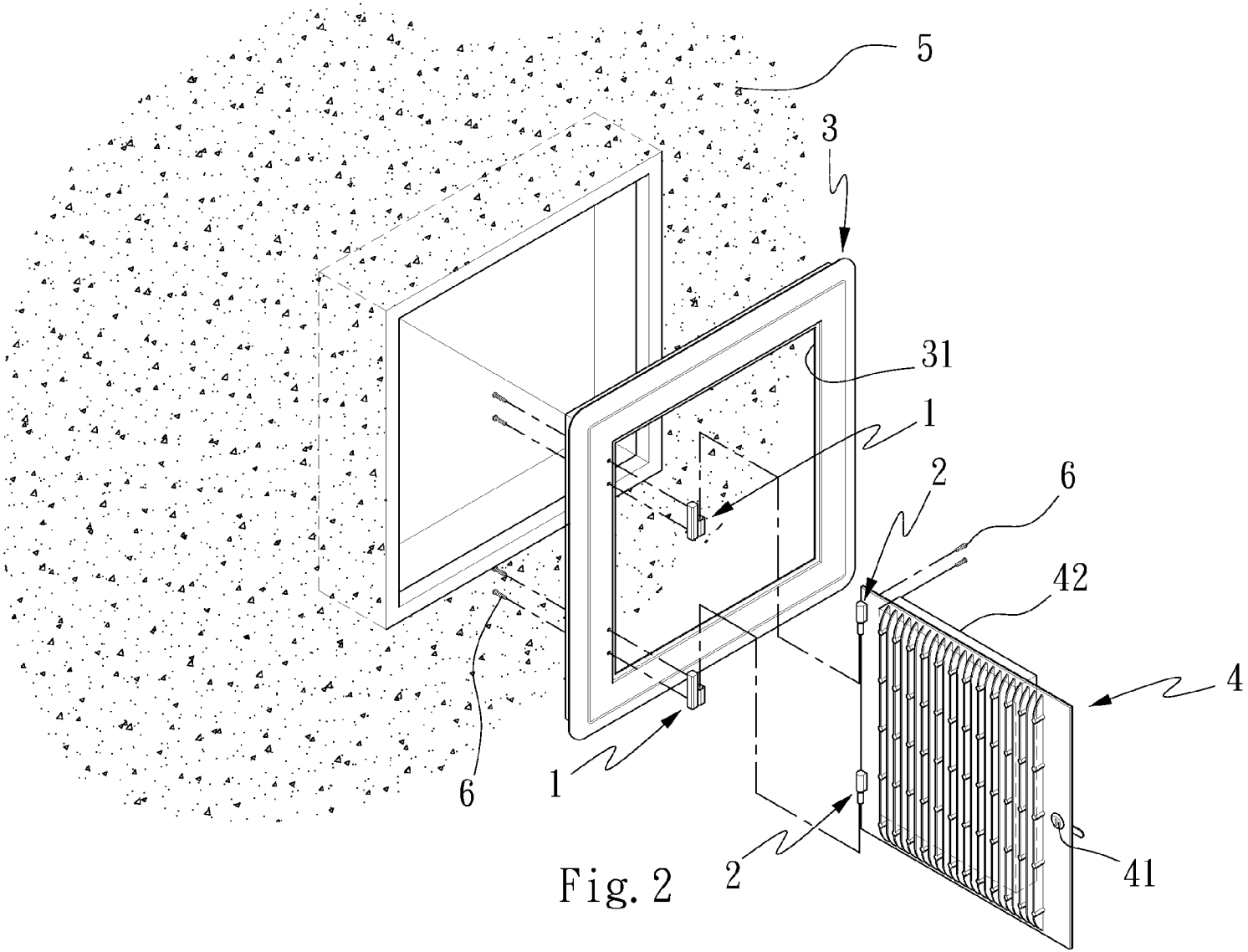
FIG. 2 is another exploded view of the hinge according to the embodiment of the present invention.
Figure 3:
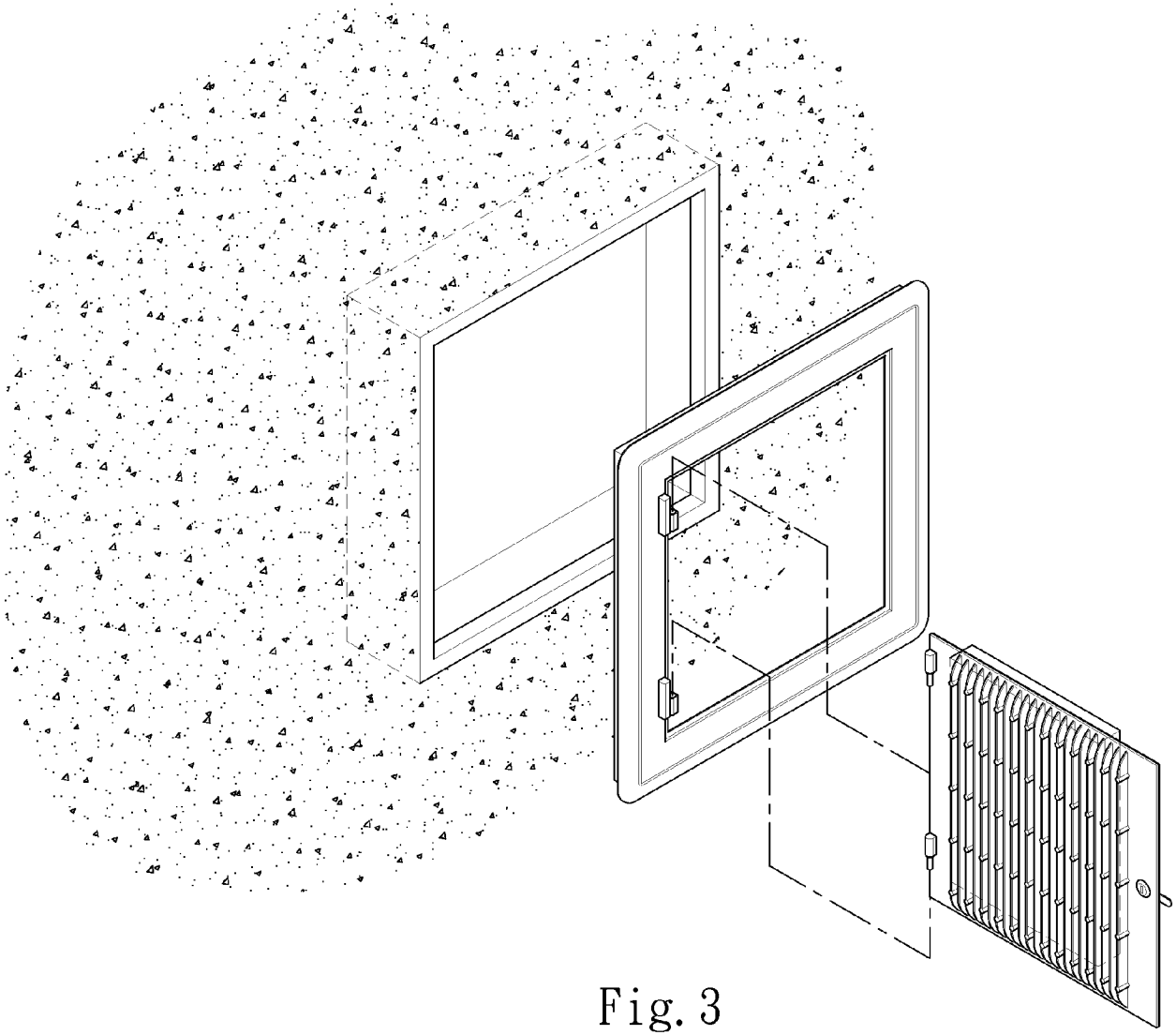
FIG. 3 is yet another exploded view of the hinge according to the embodiment of the present invention.
Figure 4:
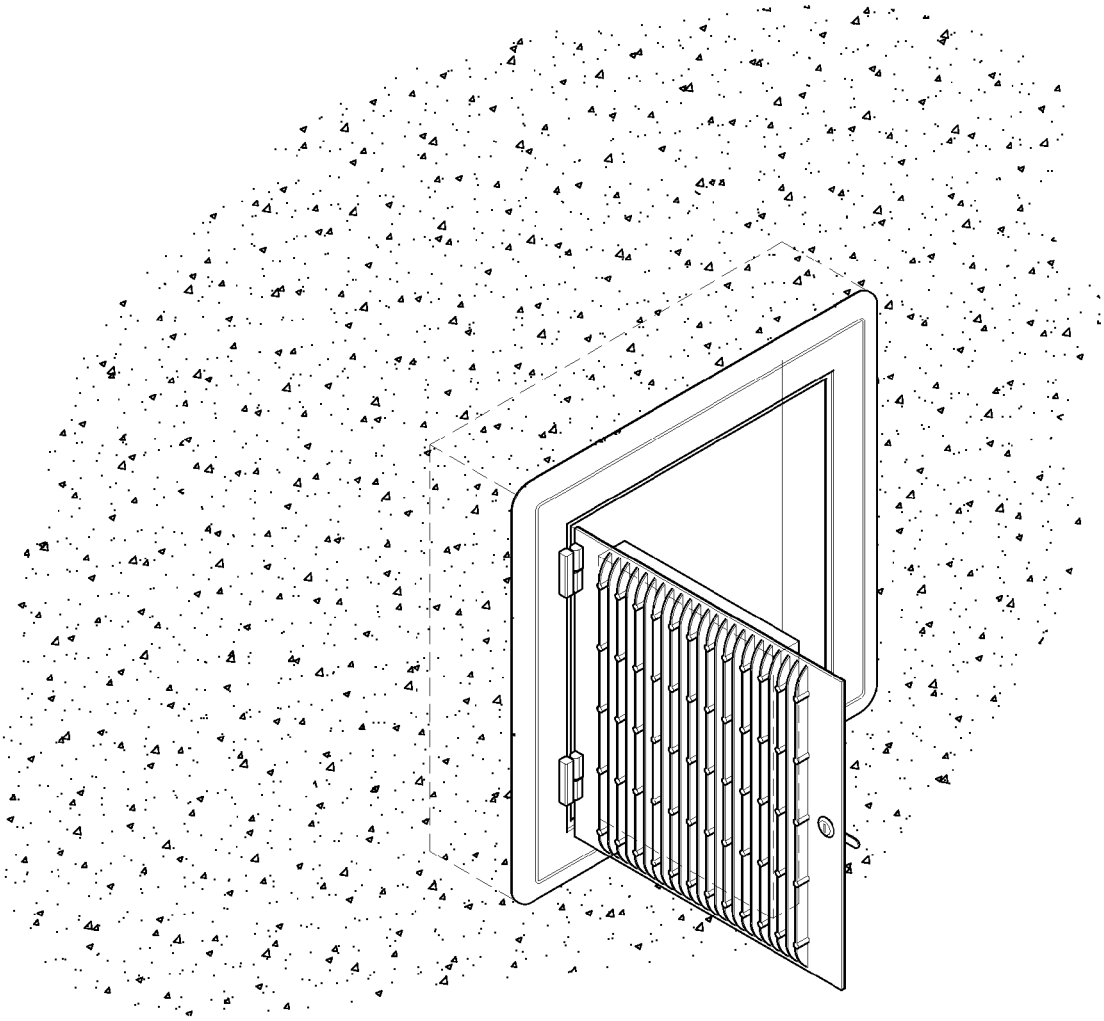
FIG. 4 is a schematic view of the hinge according to the embodiment of the present invention when assembled.
Figure 5:
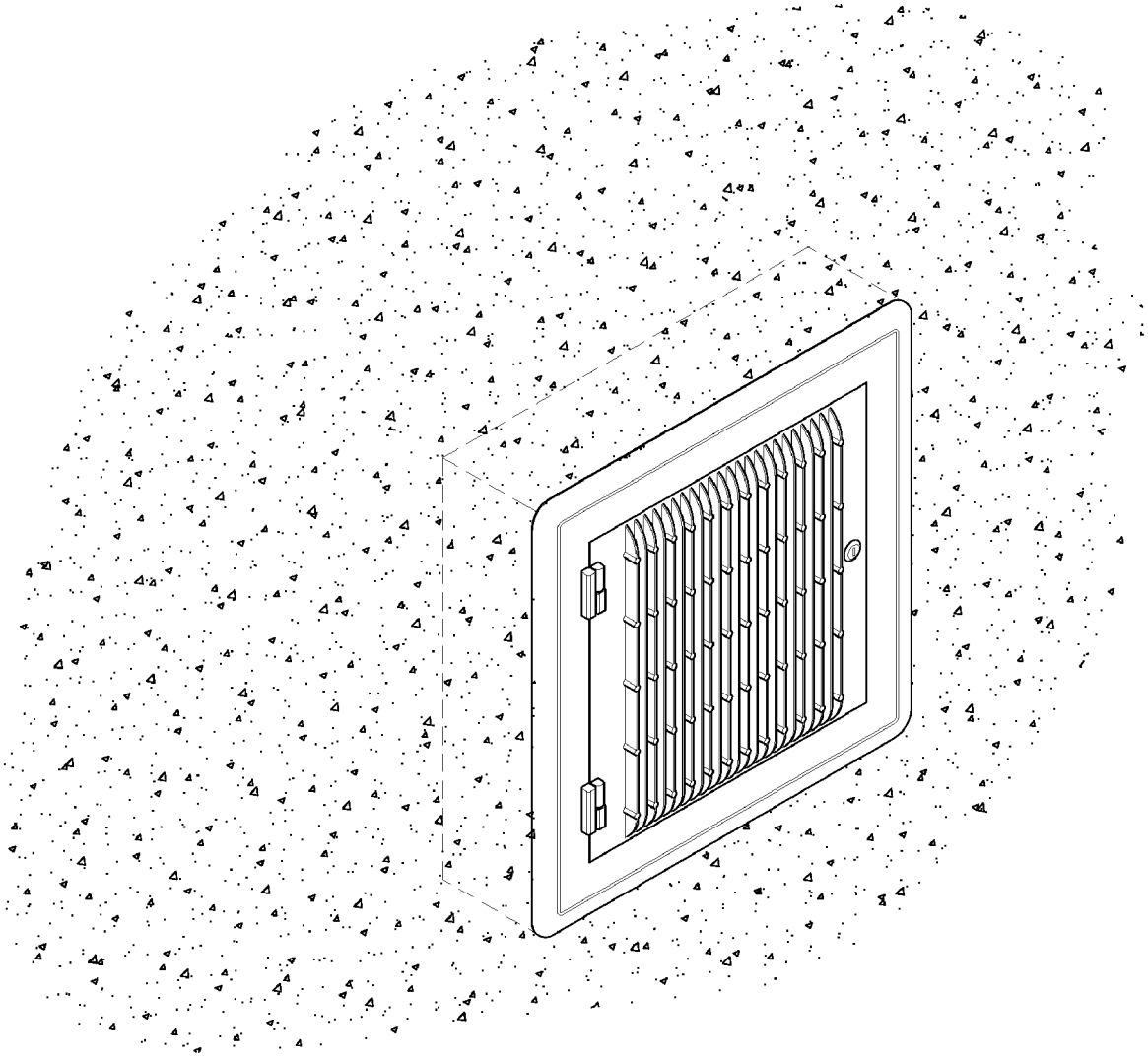
FIG. 5 is another schematic view of the hinge according to the embodiment of the present invention when assembled.
Figure 6:
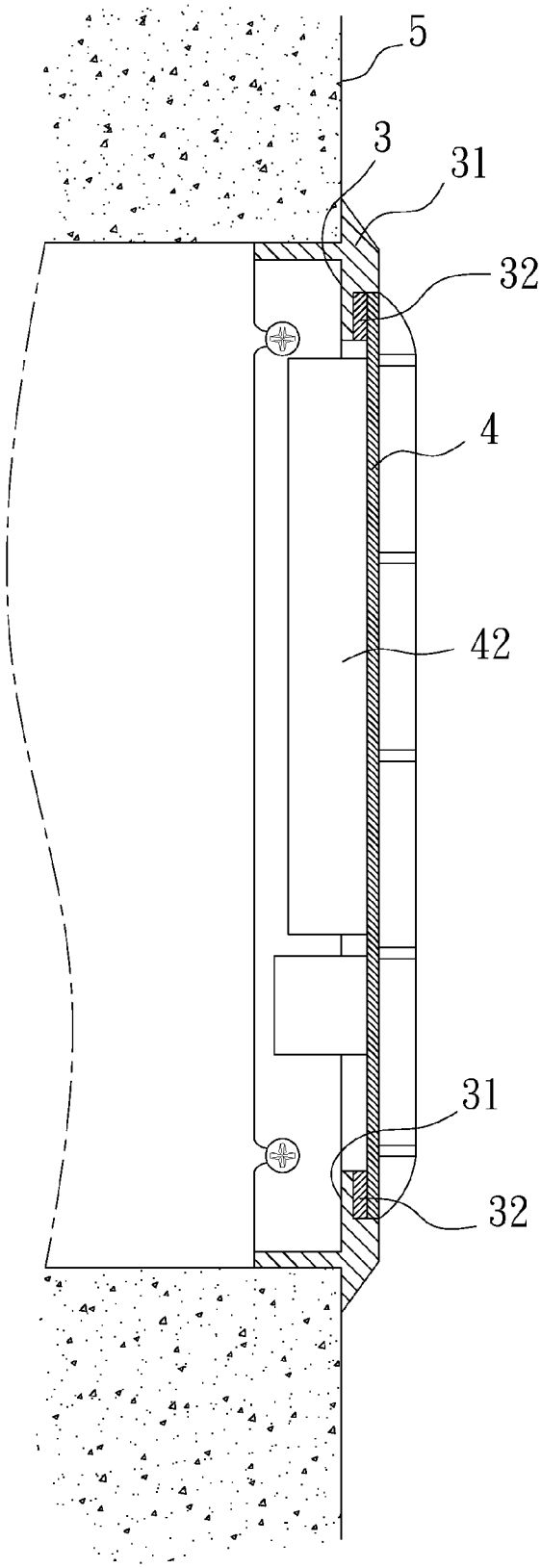
FIG. 6 is a cross-sectional view of the hinge according to the embodiment of the present invention when in use.

Referring to FIG. 1 through FIG. 6, there are shown exploded views, schematic views, and a cross-sectional view of a hinge according to an embodiment of the present invention. As shown in the drawings, the hinge of the present invention is used for movably coupling a door panel 4 and a door frame 3 together and can be positioned by means of a rod-shaped tool (not shown), such as a screwdriver, a hexagonal rod, or any tool that looks like a rod. The door panel 4 has a lock 41 whereby the door panel 4 is locked to the door frame 3. An electronic device 42 is disposed on the inner side of the door panel 4, and thus the door panel 4 is heavy. A flange 31 is disposed along the inner edge of the door frame 3. Once the door panel 4 abuts against the inner edge of the door frame 3, the flange 31 will stop the door panel 4 and prevent the door panel 4 from advancing further to thereby hit the inner edge of the door frame 3; in so doing, the flange 31 protects the door panel 4 and the door frame 3 from damage which might otherwise occurs thereto following a collision therebetween. In addition, a pad 32 may be adhered to the flange 31 to serve as a buffer for mitigating the force exerted by the door panel 4 upon the door frame 3; hence, the pad 32 protects the door panel 4 and the door frame 3 from damage which might otherwise occurs thereto following a collision therebetween.

Figure 7:
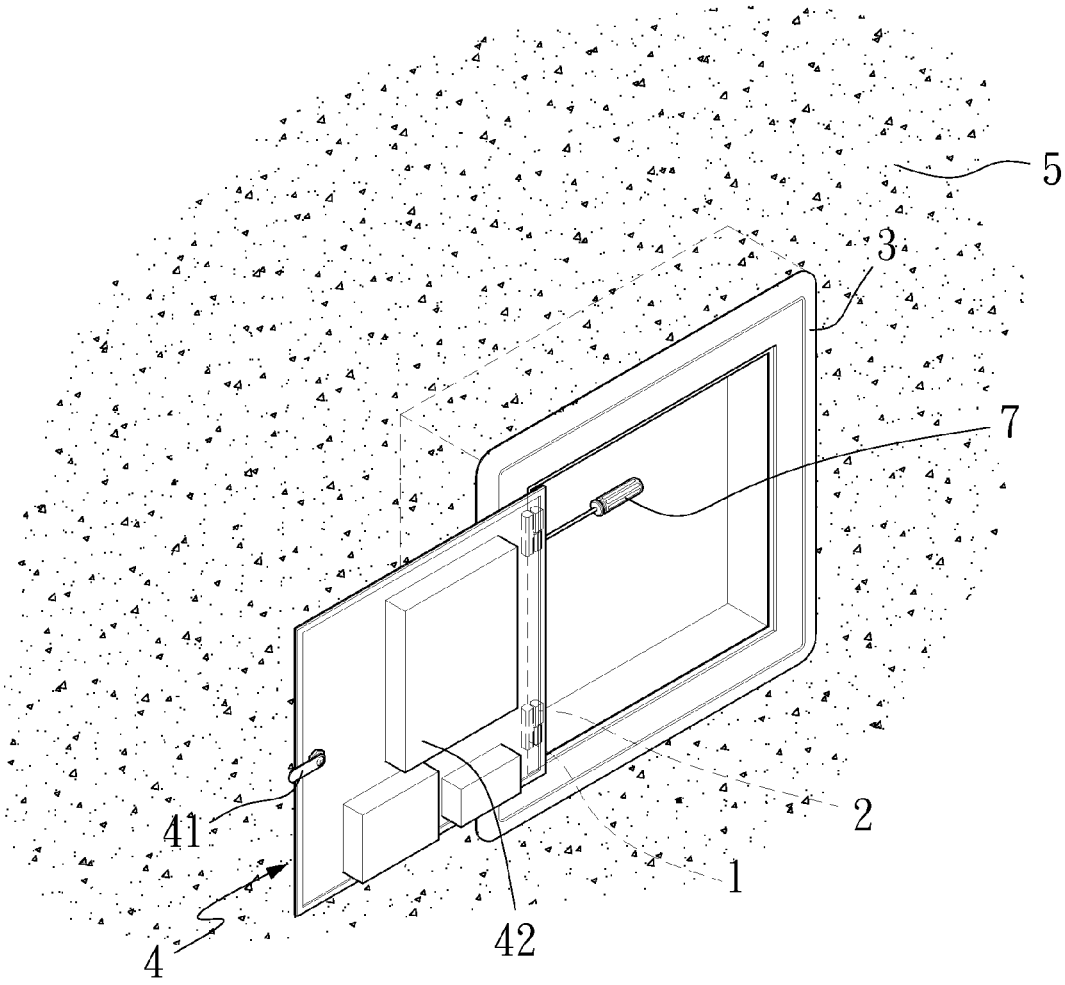
FIG. 7 is a schematic view of the hinge according to the embodiment of the present invention when in use.

The door frame 3 is disposed within an opening of a wall 5. The hinge comprises a first connection member 1 and a second connection member 2. The first connection member 1 comprises a first fixing unit 11 and a support unit 12. The first fixing unit 11 has a first fixing side 111 and a connecting side 112. The first fixing side 111 and the connecting side 112 are substantially perpendicular to each other. The first fixing side 111 can be fixed to the outer surface of a vertical side of the door frame 3. As shown in the drawings, in this embodiment, the first fixing side 111 is fixed to the outer surface of the left vertical side of the door frame 3. The support unit 12 is coupled to the connecting side 112 of the first fixing unit 11. The support unit 12 has therein a cylindrical receiving chamber 121. A via 122 is formed in the support unit 12. The via 122 communicates with the outside of the support unit 12 in the opposite direction of the connecting side 112 of the first fixing unit 11. The via 122 and the cylindrical receiving chamber 121 are in communication with each other. Referring to FIG. 7, there is shown a schematic view of the hinge according to the embodiment of the present invention when in use. As shown in the drawing, the via 122 is penetrable by a rod-shaped tool 7. The second connection member 2 has a second fixing unit 21 and a post 22. The post 22 is connected to the bottom of the second fixing unit 21. The second fixing unit 21 has a second fixing side 211 fixed to a flat surface of the door panel 4. As show in the drawings, in this embodiment, the second fixing side 211 of the second fixing unit 21 is fixed to the outer surface of the left vertical side of the door panel 4. The post 22 is removably disposed in the cylindrical receiving chamber 121 such that the post 22 is movably coupled to the door panel 4 and the door frame 3. With the post 22 rotating inside the cylindrical receiving chamber 121, the door panel 4 can engage with and disengage from the door frame 3. The door panel 4 is rotatably mounted on the door frame 3 through the hinge and under the weight of the door panel 4 and the weight the electronic device 42. To dismount the door panel 4 from the door frame 3, all a user needs to do is to take hold of the door panel 4 firmly and push the door panel 4 upward. The post 22 has therein a positioning hole 221 for receiving an end portion of the rod-shaped tool 7 when aligned with the via 122.

Both the first fixing unit 11 and the support unit 12 are hexahedral. The second fixing unit 21 is columnar. On the second fixing unit 21 is an arc-shaped surface which is opposite the second fixing side 211 in a manner that the second fixing unit 21 has a cross-section with a semicircular rim. Due to the semicircular rim of the cross-section of the second fixing unit 21, semi-cylindrical said second fixing unit 21 does not have any chance of colliding with hexahedral said first fixing unit 11 while rotating about the first fixing unit 11.

The first fixing side 111 has a plurality of first fixing bores 1111. The second fixing side 211 has a plurality of second fixing bores 2111. The door frame 3 and the door panel 4 are penetrated by a plurality of screws 6. Then, the plurality of screws 6 engage with the first and second fixing bores 1111, 2111 to thereby lock the first fixing unit 11 and the second fixing unit 21 together. As a result, the first connection member 1 and the second connection member 2 are fixed to the door frame 3 and the door panel 4, respectively.

In the scenario where the door panel 4 and the door frame 3 are in engagement, both the first fixing side 111 and the second fixing side 211 lie on the same plane, and the positioning hole 221 faces the connecting side 112. The via 122 of the support unit 12 comes into view opposite the connecting side 112 of the first fixing unit 11. The positioning hole 221 of the post 22 has rotated to thereby align with the via 122 by the time when the door panel 4 has rotated by 180° during the process of its disengagement from the door frame 3; meanwhile, the user may pass the rod-shaped tool 7 through the via 122 and insert the end portion of the rod-shaped tool 7 into the positioning hole 221 to thereby keep the door panel 4 in an open state. In addition, to implement the present invention, the user can fix the door frame 3 to the opening of the wall 5 (or to the entrance to a room in other embodiments) first. Then, the user fixes the first connection member 1 and the second connection member 2 to the door frame 3 and the door panel 4, respectively. Afterward, the user grips the door panel 4 and lowers the post 22 of the second connection member 2 into the cylindrical receiving chamber 121 of the first connection member 1 to thereby movably couple the door frame 3 and the door panel 4 together. Finally, once the door panel 4 begins to abut against the inner edge of the door frame 3, the inner edge of the door frame 3 prevents the door panel 4 from vertical or lateral displacement, and the lock 41 and the flange 31 together prevent the door panel 4 from moving forward or backward. In so doing, the door panel 4 is fixed to the door frame 3 to thereby ensure user safety inside the wall 5. To remove the door panel 4, all the user needs to do is to following the aforesaid steps reversely. Hence, the hinge of the present invention is easy to install and uninstall.

Figure 8:
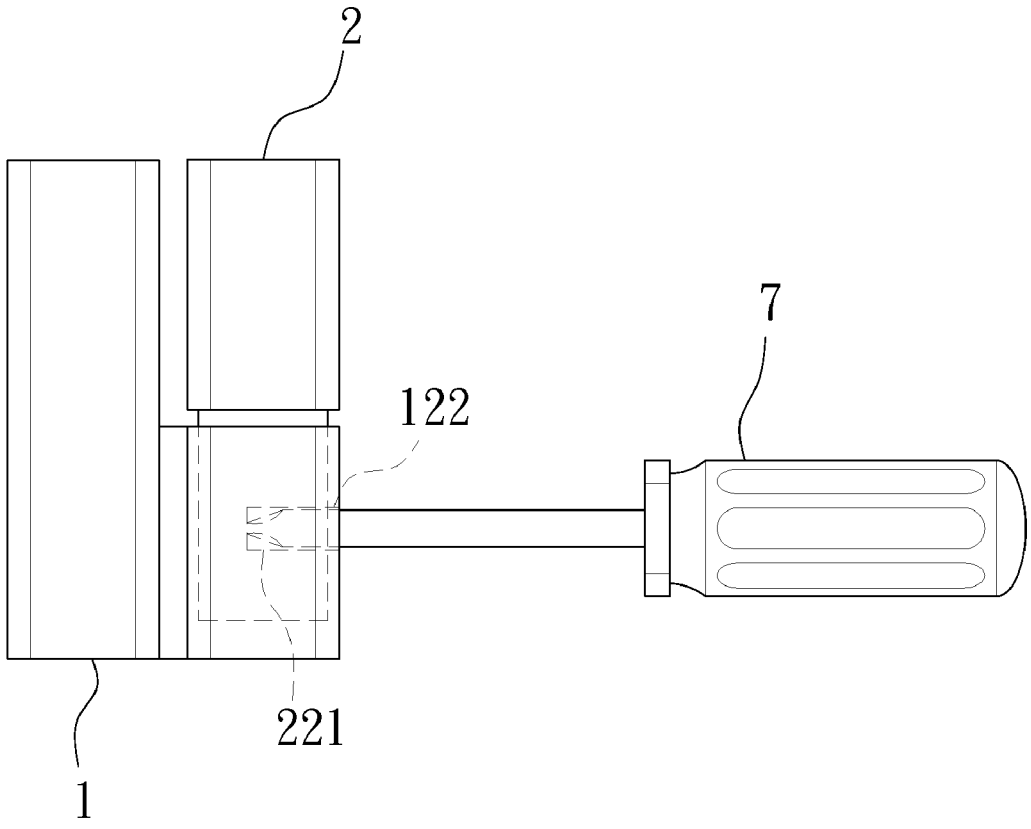
FIG. 8 is another schematic view of the hinge according to the embodiment of the present invention when in use.

Referring to FIG. 7 and FIG. 8, there are shown schematic views of the hinge according to the embodiment of the present invention when in use. As shown in the drawings, to start using the hinge of the present invention, the user may open the door panel 4 by 180°, and pass the rod-shaped tool 7 (that is, a screwdriver as shown in the drawings) through the via 122 of the first connection member 1, so as for the end portion of the rod-shaped tool 7 to be inserted into the positioning hole 221 of the second connection member 2; in so doing, the first connection member 1 and the second connection member 2 are fixed in position, thereby keeping the door frame 3 and the door panel 4 in this open state. In addition, given the aforesaid arrangement of the via 122 and the positioning hole 221, the door panel 4 and the door frame 3 can be fixed at other angles of the open state. For example, the via 122 may lie on the same plane as the first fixing side 111 does, whereas the position of the positioning hole 221 remains unchanged; in so doing, the rod-shaped tool 7 starts serving a positioning purpose as soon as the door panel 4 has been opened by 90°. Moreover, it is also feasible for the hinge of the present invention to have a plurality of said vias 122 whereby the hinge is capable of segmental positioning. Alternatively, positioning achieved at the aforesaid angles may also be effectuated even if the positioning hole 221 is located at different positions of the post 22. In conclusion, the present invention provides a hinge configured to be stably positioned by a simple mechanism and thereby be able to bear the weight of the door panel 4 and the electronic device 42. As a result, the hinge of the present invention prevents the door panel 4 from shutting by itself at any time which might otherwise pose a threat to user safety. In addition, the hinge of the present invention is advantageously characterized by ease of installation and uninstallation and thus facilities maintenance of the electronic device 42.

The foregoing embodiment is provided to illustrate and disclose the technical features of the present invention so as to enable persons skilled in the art to understand the disclosure of the present invention and implement the present invention accordingly, and is not intended to be restrictive of the scope of the present invention. Hence, all equivalent modifications and replacements made to the foregoing embodiment without departing from the spirit and principles in the disclosure of the present invention should fall within the scope of the present invention as set forth in the appended claims.

What is claimed is:

1. A hinge for movably coupling a door panel and a door frame together and capable of being positioned by a rod-shaped tool, the hinge comprising:

a first connection member comprising a first fixing unit and a support unit, the first fixing unit having a first fixing side and a connecting side substantially perpendicular to the first fixing side, the first fixing side adapted to be fixed to an outer surface of the door frame, the support unit being coupled to the connecting side and having therein a cylindrical receiving chamber, said cylindrical receiving chamber having therein a via in communication with the exterior of the support unit, said via being penetrable by the rod-shaped tool; and a second connection member comprising a second fixing unit and a post, the second fixing unit having a second fixing side adapted to be fixed to a flat surface of the door panel, the post being connected to the second fixing unit and removably disposed in the cylindrical receiving chamber so as for the post to be movably coupled to and rotated inside the cylindrical receiving chamber to thereby enable the door panel to engage with and disengage from the door frame, and the post having therein a positioning hole for receiving an end portion of the rod-shaped tool when aligned with the via, to keep the first connection member and the second connection member in a fixed position.

2. The hinge of claim 1, wherein the first fixing unit and the support unit are hexahedral, and the second fixing unit is columnar and has an arc-shaped surface opposite the second fixing side.

3. The hinge of claim 1, wherein the first fixing side has a plurality of first fixing bores for fixing the first fixing side to the door frame, and the second fixing side has a plurality of second fixing bores for fixing the second fixing side to the door panel.

4. The hinge of claim 1, wherein the positioning hole faces the connecting side when the first fixing side and the second fixing side lie on a same plane.

5. The hinge of claim 4, wherein the via is disposed in the support unit on a side that is opposite to the connecting side of the first fixing unit.

* * * * *